United States Patent [19]

Bertrand

[11] Patent Number: 4,740,189

[45] Date of Patent: Apr. 26, 1988

[54] CONSTRUCTION TOY ASSEMBLY

[75] Inventor: Vic Bertrand, Dollard des Ormeaux, Canada

[73] Assignee: The Ritvik Group, Inc., Dorval, Canada

[21] Appl. No.: 838,321

[22] Filed: Mar. 10, 1986

[51] Int. Cl.[4] ..... A63H 33/08

[52] U.S. Cl. ..... 446/128; 446/102

[58] Field of Search ..... 446/128, 102, 120, 121, 446/117, 124, 104

[56] References Cited

U.S. PATENT DOCUMENTS 3,005,282 10/1961 Christiansen ..... 446/128
3,236,004 2/1966 Christiansen ..... 446/128 X
4,061,339 12/1977 Coster .
4,375,139 3/1983 Chatani .

FOREIGN PATENT DOCUMENTS 550406 12/1957 Canada ..... 446/128
1382134 1/1975 United Kingdom ..... 446/120

*Primary Examiner*—Mickey Yu
*Attorney, Agent, or Firm*—Robic, Robic & Associates

[57] ABSTRACT

A construction toy assembly includes brick-like units of which one wall only has connecting plugs. One unit is made of two parts solid with one another and extending at 45° therebetween; another unit is also formed of two parts but the parts can pivot with respect to one another about a common axis and still another unit is in the form of a hollow open-ended tube which is rectangular in cross-section.

4 Claims, 3 Drawing Sheets

CONSTRUCTION TOY ASSEMBLY

BACKGROUND OF THE INVENTION

1. Field of the Invention

The present invention relates to a construction toy assembly using brick-like units.

2. Description of the Related Art

A construction toy assembly of the above type has been known for quite sometime and has been particularly made popular under the trade mark Lego. More recent assemblies use generally the same type of brick-like units but the units are considerably greater than the Lego units.

The brick-like modulus or units of the above known assemblies have generally all the same features. They are hollow bodies, rectangular in cross-section, formed with connection plugs projecting from one face only. The end opposite from the connecting plugs is open to permit the insertion of connection plugs of other like construction units. The drawback with building blocks or units of this type is that toy constructions can only move vertically and horizontally in two directions, that is, the constructions must follow three directions at right angles. There is no possibility of moving at an angle relative to the above three orthogonal directions. Nor is there any possibility of pivoting a portion of a structure relative to another portion. These drawbacks considerably reduce the building possibilities of these known blocks.

SUMMARY OF THE INVENTION

The present invention proposes new units which make it possible to avoid the above drawbacks.

Thus, according to the invention, there is provided a first additional unit which is made of two parts of equal constant rectangular cross-section, these parts being solidly joined together along a common end and at essentially 45°. The end of one of the parts, opposite the common end, is closed and connecting plugs project from this closed end. The other of the parts is hollow and its end which is opposite the common end is open for the snug reception of connection plugs of another assembly unit.

A second additional unit is made of two parts of equal constant rectangular cross-section which are joined together along a common end for relative pivotal movement about an axis normal to and centrally of the rectangular cross-section. Like the first additional unit, the end of one of the parts opposite the common end, is closed and connection plugs project from this closed end. The other of the parts is hollow with its end opposite the common end open for the snug reception of connection plugs of another assembly unit.

The third additional unit comprises four consecutive walls defining a hollow body of constant rectangular cross-section open at both ends for the snug reception of connection plugs of another assembly unit, this third additional unit further comprising connection plugs projecting from one only of the consecutive walls.

A description now follows of one embodiment of the invention having reference to the appended drawing.

BRIEF DESCRIPTION OF THE DRAWING

FIG. 6 is an end view of a third improved unit and FIG. 7 a view along line 7—7 of FIG. 6;

DESCRIPTION OF THE PREFERRED EMBODIMENT

Figure 1:
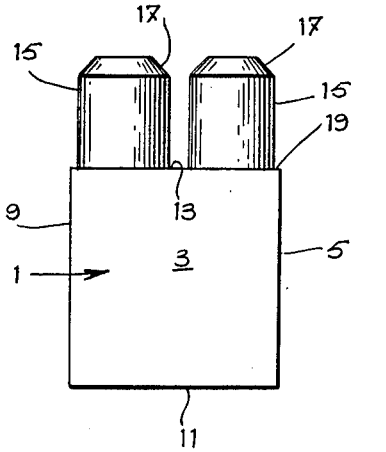
FIG. 1 PRIOR ART
FIGS. 1 and 2 are, respectively, side elevation and plan views of a known construction toy assembly unit.
Figure 2:
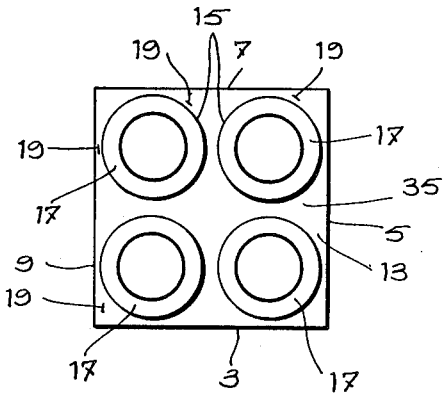
FIG. 2 PRIOR ART

As said above, FIGS. 1 and 2 illustrate a known brick-like assembly unit. It is shown to comprise a hollow rectangular parallelepiped body 1 made of four consecutive walls 3, 5, 7 and 9, adjacent edges of these walls defining an open end 11 while a fifth wall 13, normal to walls 3, 5, 7 and 9, closes the end of body 1 opposite the open end 11. Fifth wall 13, in FIGS. 1 and 2, is provided with four symmetrically disposed parallel spaced connection plugs 15. Plugs 15 are cylindrical bodies having their upper ends chamfered at 17. They are positioned, on the top wall 13, so as to leave a narrow ledge area 19 of which the width is essentially equal to the thickness of the walls 3 to 9 so that the connecting plugs 15 define confining wall means suitable for the plugs 15 to fit snugly into the hollow chamber of a like assembly unit, as is known.

Figure 3:
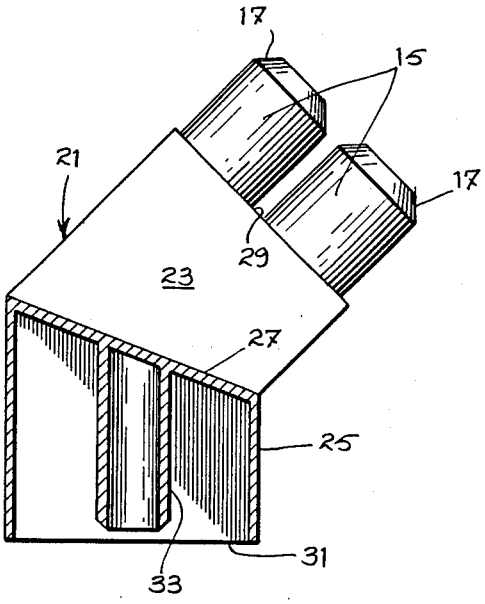
FIG. 3 is a side elevation view, partly in cross-section, of a first improved assembly unit made according to the invention.

A first additional building unit, made according to the invention, is shown at 23 in FIG. 3. It is seen to be made of two parts 23, 25, of equal constant rectangular cross-sections solidly joined together along a common end, which may be a solid wall 27, and at essentially 45°. The end of part 23 opposite the common end 27 is a solid wall 29 from which connection plugs 15 project. That part 23 may be completely solid although it will usually be hollowed out.

The other part 25 is hollow and its end 31 is open for the snug reception of connection plugs of another assembly unit.

An assembly stabilizing elongated member 33, which may be tubular, projects from the solid wall 27 centrally into the hollow part 25, stabilizing member 33 being round in cross-section and being sized so that it may fit in the nip 35 (FIG. 2) tangentially between two connection plugs 15 of another assembly unit. Likewise, when the hollow part 25 is made to sit squarely over top wall 9 of the unit one of FIG. 2, the stabilizing member 33 becomes tangent to all four plugs 15 and, in both situations, it serves to prevent wobbling between interconnected building units.

Figure 4:
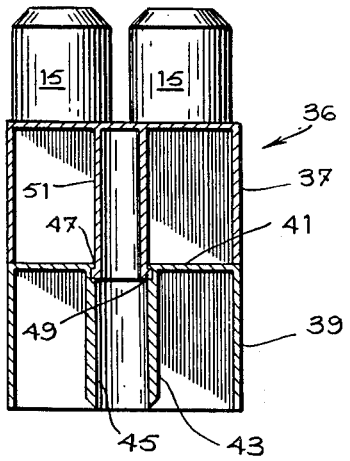
FIG. 4 is a longitudinal cross-sectional view of a second improved unit and FIG. 5 a bottom view thereof.
Figure 5:
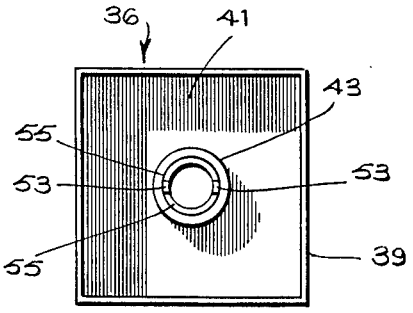
Figure 8:
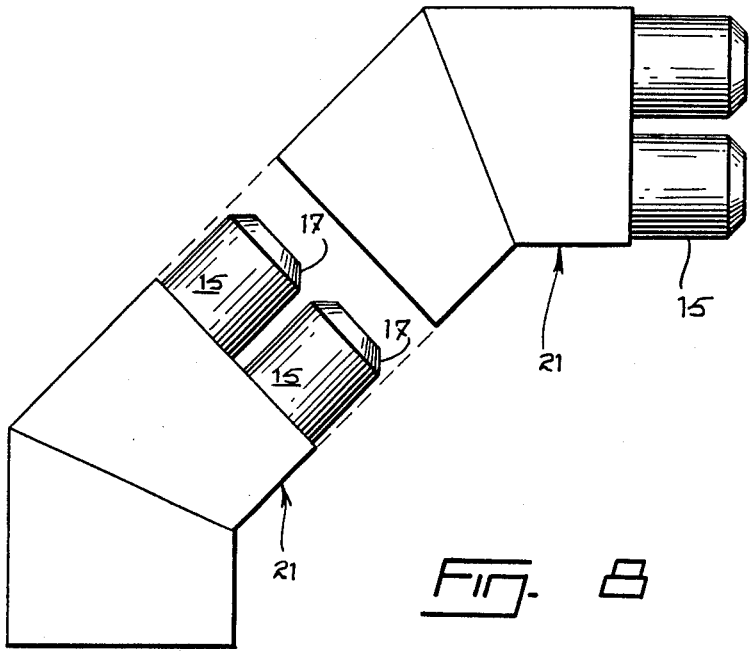

A second additional unit 36 according to the invention is shown in FIGS. 4 and 5. This unit is also made of two parts 37, 39, wherein part 37 may either be solid or preferably hollow. Both parts 37 and 39 are of equal constant cross-section and means are provided to join them at a common end for relative pivotal movement about an axis which is normal to and centrally of this rectangular cross-section. Part 39 has a solid closing wall 41 at the common end between parts 37 and 39. As in the additional unit shown in FIG. 4, a stabilizing member 43 depends from the solid wall 41 and defines a bore 45 having a bottom wall merging with the common end solid wall 41. This bottom wall, as shown, is centrally pierced to form a locking aperture 47. The pivot means aforesaid, between parts 37 and 39, is shown to comprise a bulb element 49, provided at the end of a tubular rod 51 solid, at one end, with part 37, the bulb element 49 projecting past the common end wall 41. It is seen to be formed of a narrow portion extending freely through the locking aperture 47 and of a wide portion received in the bore 45 and bearing freely against the bore bottom wall. As best illustrated in FIG. 5, the wide portion of the bulb 49 is longitudinally slit at 53 to thus define two resilient legs 55 to permit insertion of the bulb element 49 into the bore 45 through the locking aperture 47. This construction makes it possible to hold part 37 firmly over wall 41 while allowing relative rotation about a longitudinal axis common to both parts 37 and 39.

Figure 7:
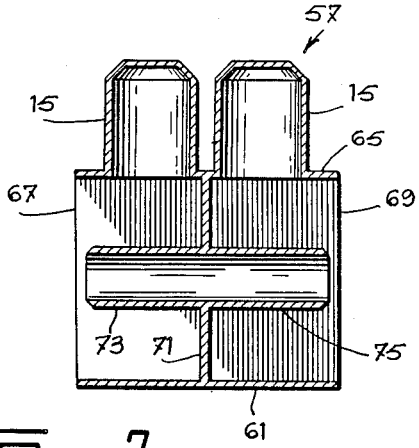

The third additional unit 57 according to the invention is shown in FIGS. 6 and 7.

It is seen to comprise four consecutive walls 59, 61, 63 and 65 defining a hollow body of constant rectangular cross-section open at both ends 67, 69, for the snug reception of connecting plugs 15 of another assembly unit, as explained earlier with respect to the other additional units. The connecting plugs 15 of this third additional unit project from only one wall 65 of the four consecutive walls.

This third unit further comprises a solid partition wall 71 within and centrally of the hollow body defined by the consecutive walls 59–65 and perpendicularly thereto. Coaxial assembly stabilizing elongated members 73, 75, which may be hollow, project from the center of the petition wall 71 toward the open ends 67, 69, and serve the same purpose as the stabilizing members 33 and 43 of the first and second additional units aforedescribed.

Figure 8:
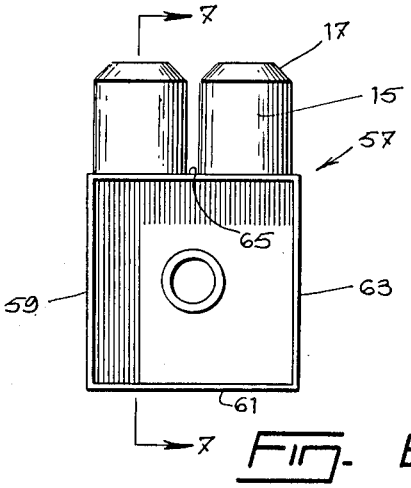
FIG. 8 is a side elevation view of two units, according to the first improved unit of FIG. 3, about to be assembled.

FIG. 8 shows two additional units 21 of the first type about to be interconnected.

Figure 9:
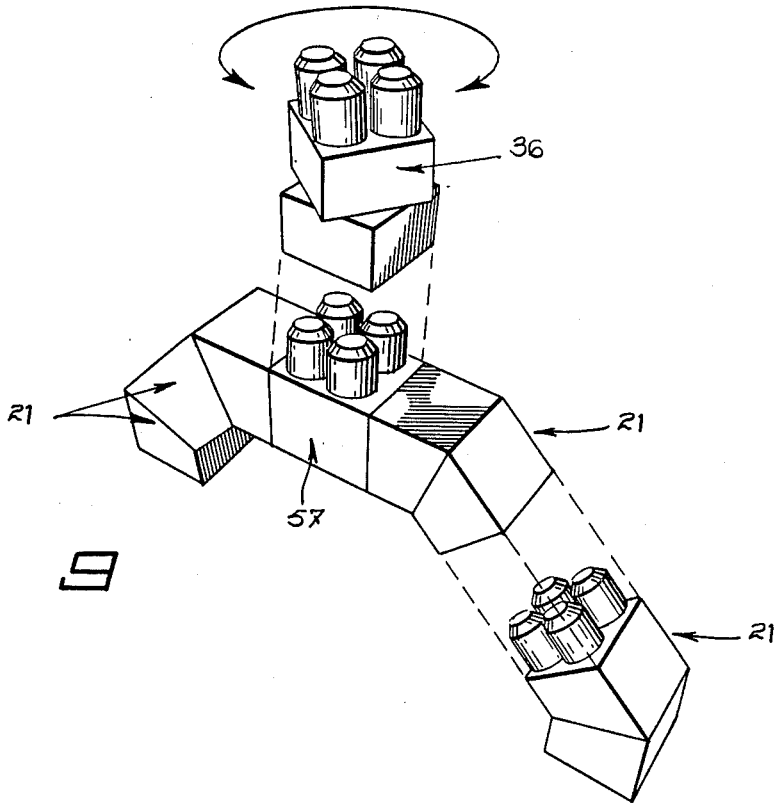

FIG. 9 shows one type of construction which uses exclusively the three additional units 21, 57 and 36 of the invention. Unit 36 particularly illustrates how an upper part of a construction (not shown) may be pivoted about a lower part serving as a base.

Figure 10:
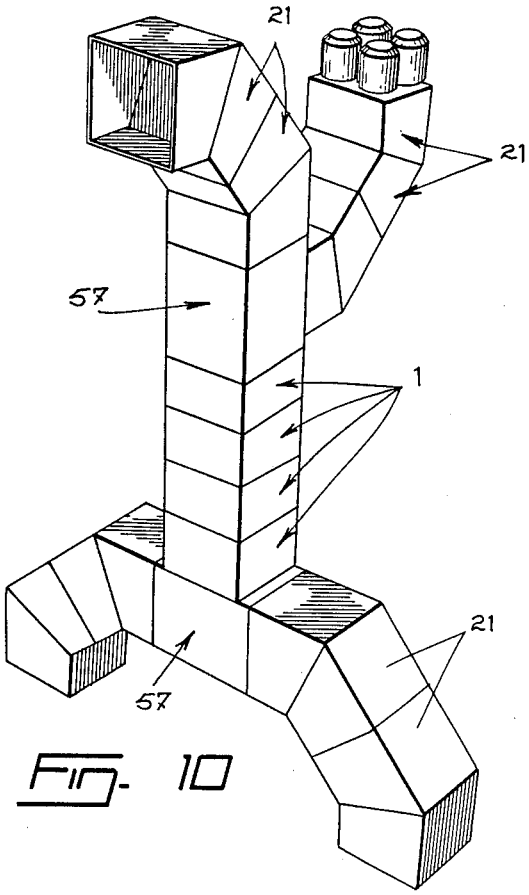
FIGS. 9 and 10 are perspective views of two different assemblies involving conventional units and units improved according to the teaching of the present invention.

The arrangement shown in FIG. 10 illustrates a construction using both conventional units 1 mounted on a base made up of additional units 21, 57, and supporting an upper structure made up of additional units 57 and 21 of the invention.

I claim:

1. In a construction toy assembly comprising a plurality of brick-like assembly units, each unit being in the form of a hollow rectangular parallelepiped body having five walls of which adjacent edges of four of said walls define an open end and the fifth wall is normal to said four walls and faces said open end, wherein said fifth wall is provided with four relatively long, symmetrically disposed parallel connection plugs equally spaced from one another and defining confining wall means snugly insertable in the hollow body of a like assembly unit, said plugs outwardly upstanding from said fifth wall, the improvement comprising at least one additional assembly unit made of two parts of equal constant rectangular cross-section and including means joining said parts at a common end thereof for relative pivotal movement about an axis normal to and centrally of said rectangular cross-section, wherein:

the other end of one of said parts, opposite said common end, is closed;

said additional unit comprises four relatively long, symmetrically disposed parallel connection plugs equally spaced from one another and projecting outwardly from said closed end;

the other of said parts is hollow with the end thereof opposite said common end being open for the snug reception of the four connection plugs of another assembly unit to be connected to said additional unit;

said additional unit further comprises a solid wall along said common end and an assembly stabilizing elongated member projecting from said common end solid wall centrally into said other, hollow part of said one additional unit;

said assembly stabilizing member is round in cross-section and is sized for insertion of at least a portion thereof tangentially between at least two of said four connection plugs of said other assembly unit to be connected to said additional unit;

said tangentially inserted portion of the assembly stabilizing member being sufficiently long to allow the set stabilizing member-connection plugs to resist to a lever force applied on said additional unit;

said common end solid wall closes said other, hollow part of said one additional unit;

said assembly stabilizing member is tubular and defines both a bore and an annular, end wall merging with said common end solid wall, said annular, end wall defining an opening to form a locking aperture; and said pivot means comprises a bulb element projecting centrally from the closed end of said one part of said additional unit past said common end, said bulb element having a narrow portion extending freely through said locking aperture and a laterally resilient wide portion received in said bore and bearing freely against said end bottom wall.

2. A construction toy assembly as defined in claim 1, further comprising at least one second additional assembly unit made of two second parts of equal constant rectangular cross-section, said second parts being solidly joined together along a common end and at essentially 45°, wherein:

the end of one of said second parts, opposite said common end, is closed;

said one second additional unit comprises four relatively long, symmetrically disposed parallel connection plugs equally spaced from one another and projecting outwardly from the closed end of said one second part;

the other of said second parts is hollow with the end thereof opposite said common end being open for the snug reception of the four connection plugs of another assembly unit to be connected to said one second additional unit;

said one second additional unit further comprises a second solid wall along said common end and a second assembly stabilizing elongated member projecting from said common end, second solid wall centrally into said hollow, second part;

said second stabilizing member is round in cross-section and is sized for snug insertion of at least a portion thereof tangentially between at least two of said four connection plugs of said other assembly unit to be connected to said first additional unit; and said tangentially inserted portion of the second stabilizing member being sufficiently long to allow the set second stabilizing member-connection plugs resist to a lever force applied on said one second additional unit.

3. A construction toy assembly as defined in claim 1, further comprising at least one second additional assembly unit comprising four consecutive walls defining a hollow body of constant rectangular cross-section open at both ends for the snug reception of the four connection plugs of two other assembly units to be connected to said second additional unit, and further comprising four relatively long, symmetrically disposed parallel connection plugs equally spaced from one another and projecting outwardly from one only of said four consecutive walls, wherein:

said second additional unit further comprises a solid partition wall within said hollow body, centrally of and perpendicular to said only one wall having said four connection plugs, and two second coaxial assembly stabilizing elongated members projecting from the center of said partition wall, perpendicularly thereof and toward said two open ends of said second additional unit, respectively;

said two second stabilizing members are round in cross-section and are sized for respective insertion of at least portions thereof tangentially between at least two of said four connection plugs of said two other assembly units; and said tangentially inserted portions of the second stabilizing members being sufficiently long to allow the two sets second stabilizing member-connection plugs to resist to a lever force applied on said second additional unit.

4. A construction toy assembly as defined in claim 2, further comprising at least one third additional assembly unit comprising four consecutive walls defining a hollow body of constant rectangular cross-section open at both ends for the snug reception of the four connection plugs of two other assembly units to be connected to said third additional unit, and further comprising four relatively long, symmetrically disposed parallel connection plugs equally spaced from one another and projecting outwardly from one only of said four consecutive walls, wherein:

said third additional unit further comprises a solid partition wall within said hollow body, centrally of and perpendicular to said only one wall having said four connection plugs, and two third coaxial assembly stabilizing elongated members projecting from the center of said partition wall, perpendicularly thereof and toward said two open ends of said third additional unit, respectively;

said two third stabilizing members are round in cross-section and are sized for respective insertion of at least portions thereof tangentially between at least two of said four connection plugs of said two other assembly units; and said tangentially inserted portion of the third stabilizing members being sufficiently long to allow the two sets third stabilizing member-connection plugs to resist to a lever force applied on said third additional unit.

* * * * *